United States Patent [19]

Lang

[11] 4,154,044

[45] May 15, 1979

[54] APPARATUS FOR SEALING CANS WITH LIDS UNDER VACUUM

[75] Inventor: Hans-Jörg Lang, Biberbach, Fed. Rep. of Germany

[73] Assignee: Ludwig Schwerdtel GmbH, Karlsfeld, Fed. Rep. of Germany

[21] Appl. No.: 823,879

[22] Filed: Aug. 11, 1977

[30] Foreign Application Priority Data

Aug. 11, 1976 [DE] Fed. Rep. of Germany ..... 2636003

[51] Int. Cl.[2] ..... B65B 31/02

[52] U.S. Cl. ..... 53/97; 53/510

[58] Field of Search ..... 53/86, 89, 95, 97, 101, 53/112 R

[56] References Cited

U.S. PATENT DOCUMENTS

| | | | |
|---|---|---|---|
| 2,510,457 | 6/1950 | Bjering | 53/89 X |
| 3,340,668 | 9/1967 | Bofinger | 53/112 R X |
| 3,908,334 | 9/1975 | Rychiger | 53/86 |

*Primary Examiner*—Travis S. McGehee

*Attorney, Agent, or Firm*—Browdy & Neim

[57] ABSTRACT

An apparatus for sealing cans with lids under vacuum is provided with a vacuum chamber. The chamber is formed by two parts vertically movable by a lifting device relative to one another so that the chamber is closed when these parts have been moved together and open when these parts have been moved apart. A vacuum bell is mounted on the upper one of the two parts. The lower part has a recess in a surface thereof for receiving a can. A pressure plate movable to a limited extent relative to the upper part and forming part of a sealing device is provided to press a lid onto a can. Only the lower part is movable, the upper part is made fixed. The vacuum bell is movable relative to the fixed, upper part when the vacuum chamber is closed. A lifting device which effects movement of the lower part can be stopped in an intermediate position, in which the vacuum chamber is already closed, but the pressure plate is still in a lower position a short distance from the can. The pressure plate is displaceable by the can into a position against a stop which corresponds to an end position of the lifting device.

8 Claims, 4 Drawing Figures

FIG. 1
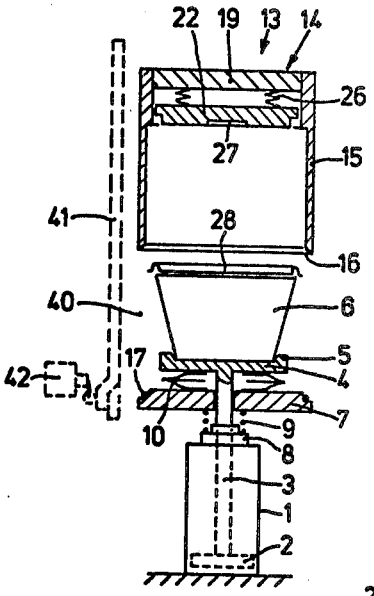
FIG. 2
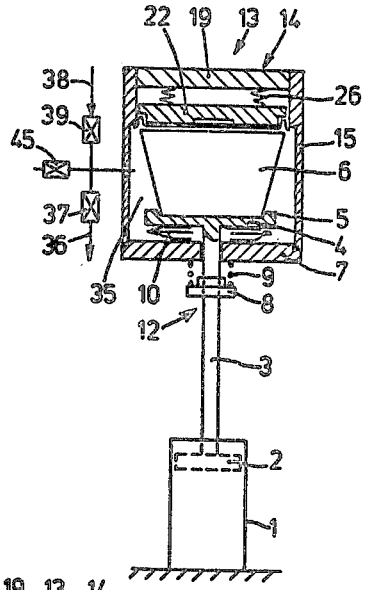
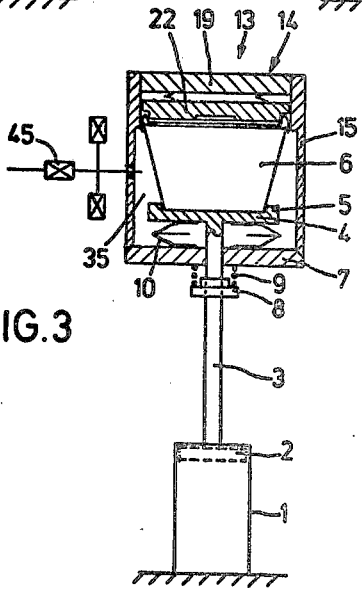
FIG. 3

APPARATUS FOR SEALING CANS WITH LIDS UNDER VACUUM

BACKGROUND OF THE INVENTION

This invention relates to an apparatus for sealing cans with lids under vacuum using a vacuum chamber formed by two parts, these parts being, relative to one another, vertically movable toward and away from one another by a lifting device. The present invention relates, more particularly, to such an apparatus in which the parts can move into a closed position and apart into an open position of the vacuum chamber, a vacuum bell being mounted on one of the two parts, the bell being applicable in a gas-tight manner to the other part to enclose the vacuum chamber, the lower part being provided with a recess for the can, and a pressure plate of a sealing device, movable to a limited extent relative to the upper part being provided to press a lid on a can.

An apparatus of this kind, known from German Offenlegungsschrift (laid open patent application) No. 2,317,517 is provided with a total of three lifting devices designed as pneumatically chargeable lifting cylinders, one of which actuates a lower vacuum bell, a second actuates an upper vacuum bell, and a third actuates the pressure plate of a sealing apparatus. The operation is such that a can, provided with a lid, is placed in a lower plate-shaped recess after the lower vacuum bell has descended, after which the lower vacuum bell is moved upward and the upper vacuum bell is moved downward until the vacuum chamber is enclosed. Then the pressure plate, provided with a permanent magnet, a pneumatically acting sucker or the like, moves against the cover and then returns, leaving the lid adhering to the pressure plate. Then the vacuum chamber is evacuated, after which the lid is pressed onto the can by means of the pressure plate. Then air is admitted to the vacuum chamber again and the two vacuum bells move apart, upward and downward, respectively.

Although this known apparatus operates well in theory, it has the significant disadvantage that a considerable amount of effort is required for the three lifting devices and the switches required to control them, this effort being justified only for fully automatic apparatus having a high efficiency which operate under a continuously full load.

SUMMARY OF THE INVENTION

The principal object of the present invention is to provide an apparatus of the type described hereinabove, the apparatus also being economically usable under low load conditions.

The foregoing object, as well as others, which are to become apparent from the text below, is achieved according to the present invention by virtue of the fact that only one of the two parts is movable, the other part being fixed, by the fact that the vacuum bell is movable relative to one part when the vacuum chamber is closed, by the fact that the lifting device can be stopped in an intermediate position, in which the vacuum chamber is already closed, but the pressure plate is still in a lower position a short distance from the can, and by the fact that the pressure plate is displaceable by means of the can into a position against a stop which corresponds to one end position of the lifting device. By these members, a situation is created in which the vacuum chamber can be opened and closed and the can sealed by a single lifting device. Therefore, the vacuum chamber is initially closed and evacuated, then, by using the same lifting device, the can is advanced relative to the closing device within the interior of the vacuum chamber, and the lid is pressed on.

According to an advantageous embodiment of the invention, a sealing plate is mounted in a gas-tight manner, the plate being displaceable under spring tension relative to the lower part when the vacuum bell is pressed against it, i.e., in the above-mentioned intermediate position of the lifting device the vacuum chamber is closed, but the can can be advanced further relative to the sealing device, since the sealing plate can be displaced relative to the recess against the pressure of a spring.

The gas-tight application of the sealing plate advantageously occurs in such fashion that at least one sealing ring is provided between the sealing plate and the part guiding the latter. Alternatively, an axially expandable sealing sleeve can be provided between the recess and the sealing plate. In this connection it has been found especially advantageous to have the vacuum bell attached to the upper part, in other words, so that it rests against the sealing plate when the vacuum chamber closes.

Advantageously, the pressure plate is mounted in a guided fashion on a base plate, and is displaceable between a lower and an upper position, each delimited by stops.

In order to ensure reliable evacuation, it is advantageous for the pressure plate to be provided with a holding device which raises the lid off the can in the intermediate position, the holding device being a permanent magnet. In contradistinction to the apparatus described initially, the pressure plate is not moved toward the lid and then away from the latter in order to lift off the lid, but the lid is raised by the force of the permanent magnet and lifted through a distance of several millimeters. A pneumatically operating holding device is unsuitable, since it would not hold the lid when the vacuum chamber was evacuated.

BREIF DESCRIPTION OF THE DRAWINGS

Further advantages and features of the invention are to become apparent from the description of an exemplary embodiment described below with reference to the drawings.

FIG. 1 is a somewhat diagrammatic, elevational view, partially in section, of an apparatus for sealing cans with lids according to the present invention showing a first position of a lifting device therein;

FIG. 2 is a diagrammatic, elevational view, partially in section, of the apparatus shown in FIG. 1, with the lifting device in an intermediate position;

FIG. 3 is a view of the apparatus according to FIGS. 1 and 2 showing the other end position of the lifting device.

DETAILED DESCRIPTION OF THE PREFERRED EMBODIMENT

Figure 4:
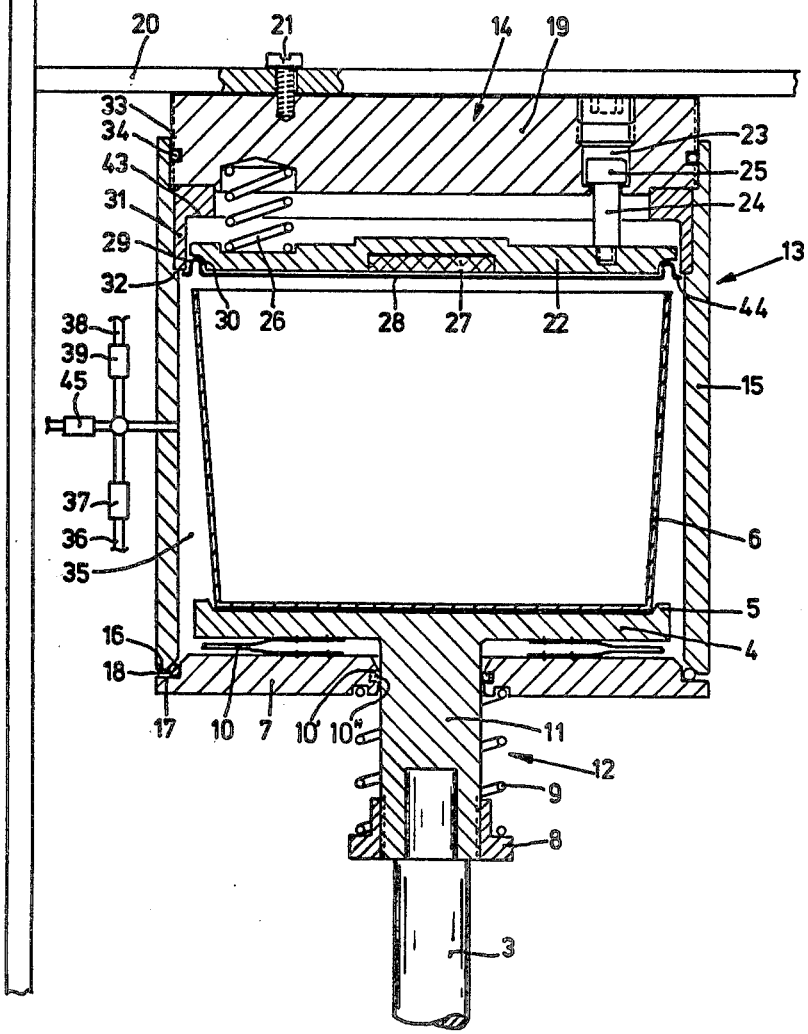
FIG. 4 is a partially cut-away of FIG. 2 shown on an enlarged scale.

The apparatus shown in the drawings is provided with a lifting cylinder 1 mounted in a fixed position and pneumatically chargeable. A piston rod 3 of the cylinder 1 is provided with a piston 2 and is mounted vertically, the rod 3 being brought out of lifting cylinder 1 at its top in a conventional sealed manner. At the upper free end of the piston rod 3 a plate-like member 4 is provided. As illustrated, the plate-like member 4 is integral with the piston rod 3. The plate-like member 4 has an integral collar 5 to accept a can 6 to be sealed in a centered manner.

A sealing plate 7 is displaceably mounted in an axially limited manner below the plate 4. A stop collar 8 is mounted axially non-displaceably between the sealing plate 7 and the lifting cylinder 1 on the piston rod 3, with a compression spring 9 in the form of a coil spring abutting the collar 8, and the spring 9 having its other end abutting the under side of the sealing plate 7. The adjacent sides of the sealing plate 7 and the plate-like member 4 are connected together in a gas-tight manner by an annular sealing sleeve 10, i.e., no gas can pass through the cross section enclosed by this sealing sleeve 10. Instead of the sealing sleeve 10 or in addition thereto, a sealing ring 10'' (FIG. 4) mounted in a groove 10' (FIG. 4) can be provided between the sealing plate 7 and the piston rod 3 and/or a cylindrical part 11 (FIG. 4) described hereinbelow, whereby the same effect is achieved.

For reasons related to manufacturing technology, the section of the piston rod 3 from the stop collar 8 to the plate-like member 4 can be made in the form of the above-mentioned independent cylindrical part 11, connected integrally with plate-like member 4, the cylindrical part 11 being mounted on one end of the piston rod 3. This arrangement described previously and constituting the movable part 12 of the apparatus is disposed concentrically with respect to a fixed part 13. The fixed part 13 consists essentially of a sealing device 14 and a vacuum bell 15 which is approximately cylindrical and is mounted on the sealing device 14 in a gas-tight fashion, the lower edge of the bell 15 being provided with a seat 16, associated with a corresponding seat 17 on the sealing plate 7. In addition, a sealing ring 18 is provided in the seat 17 of the sealing plate 7 which fits tightly against the seat 6 when the sealing plate 7 and the vacuum bell 15 come together.

The sealing device 14 consists essentially of a base plate 19, attached to a corresponding part of machine frame 20 by screws 21. A pressure plate 22 is mounted movably and axially delimited on the side of the approximately cylindrical ring-shaped base plate 19 which faces the recess in the surface of the plate-like member 4. A plurality of apertures 23, only one being visible in FIG. 4, are provided in the base plate 19 in which apertures 23 respective guide pins 24 are displaceably mounted, the pins 24 being screwed into the downwardly facing side of the pressure plate 22. The guide pins 24 are each provided with a head 25 disposed in a corresponding aperture 23. The apertures 23 have a smaller diameter at the end facing the pressure plate 22 than their heads 25, so that the guide pins 24 cannot fall out downwardly from the corresponding apertures 23, i.e., the maximum distance of the pressure plate 22 from the base plate 19 is determined in this fashion. In addition, compressed compression springs 26, only one being visible in FIG. 4, are disposed between the pressure plate 22 and the base plate 19, the springs 26 essentially pressing the pressure plate 22 to its maximum possible distance away from the base plate 19. A holding device 27 to hold a lid 28 for a can 6 is disposed on that side of the pressure plate 22 which faces the can 6. In the exemplary embodiment the holding device 27 is a permament magnet. A lid 28 to be placed on the can 6 is provided with a groove-shaped, up-turned edge 29 which is downwardly open, the inside shape of the edge 29 matching a centering edge on the pressure plate 22, so that when the lid 28 is resting against the pressure plate 22 held by the holding device 27, the radial position of the lid 28 relative to the pressure plate 22 is determined exactly.

A pressure ring 31 is also mounted on the base plate 19, the ring 31 surrounding the pressure plate 22 radially at a short distance, and whose inside diameter is slightly smaller than the diameter of the lid 28 which is not yet attached to the can 6; the inside diameter of the pressure ring 31, however, is of the same size or slightly larger than the outside diameter of the upper edge of the can 6. This pressure ring 31 is held axially in such manner that it abuts the base plate 19 on one side and a corresponding collar 32 of the vaccum bell 75 on the other, the bell 15 being screwed against the outside circumference of the base plate 19 by a thread 33. A sealing ring 34 is also provided between the base plate 19 and the vacuum bell 15.

A vacuum chamber 35 delimited by the sealing device 14, the vacuum bell 15 and the sealing plate 7, the chamber 35 accpeting the can 6 with the lid 28, is optionally connectable to a vacuum line 36 with a corresponding vacuum valve 37 and/or a $CO_2$ line 38 with a corresponding $CO_2$ valve 39. A working chamber 40 which accepts the cylindrical part 11 and the movable part 12 in the machine frame 20 can be closed by means of a protective grating 41 facing a position from which an operator is to operate the apparatus. Instead of a protective grating 41, a protective device can be made such that a so-called two-hand operation is provided, wherein the operator can actuate the apparatus only by simultaneously operating two switches mounted a certain distance apart, the switches having to be both operated until the sealing plate 7 and the vacuum bell 15 come together.

The invention operates as follows:

If the protective grating 41 is provided, a full can 6 with a lid 28 resting loosely upon it is placed, with the protective grating 41 raised, in the recess of the plate-like member 4, either manually or by an appropriate feed device. The plate-like member 4 is in its lowered position. If the protective grating 41 is provided, its closure actuates the safety switch 42 by means of which all subsequent work steps are enabled (FIG. 1). If no protective grating is provided, the above-mentioned saftey swtich arrangement for two-hand operation is actuated. Then the lifting cylinder 1 is charged with compressed gas, i.e., the piston rod 3 travels upwardly out of the lifting cylinder 1 with the plate-like member 4, until the seat 16 of the vacuum bell 15 comes to rest in a gas-tight manner against the seat 17 of the sealing plate 7, i.e., until the vacuum chamber 35 is sealed in a gas-tight manner. In this position, in which the pressure plate 22 of the sealing device 14 is located a few millimeters above the lid 28 resting on the can 6, the supply of compressed gas is cut off. As a result of the kinetic energy of the piston rod 3 and plate-like member 4 with the cylindrical part 11, and because of the action of the compressed gas, the recess of the plate-like member 4 with the can 6 in place continues moving forward for a short distance, so that the lid 28 comes sufficiently close to the holding device 27, in the form of a permanent magnet, that the lid 28 is raised from the can 6 and comes to rest against the corresponding surface of the pressure plate 22. As the recess of the plate-like member 4 with can 6 in place thus rebounds, the distance between the can 6 and lid 28 is again increased to several millimeters. In this position, the vacuum valve 37 is first opened and the vacuum chamber 35 evacuated to a pressure of 100 torr, for example. After the vacuum valve 37 closes, for example, the $CO_2$ valve 39 is opened and the vacuum chamber 35 is filled with $CO_2$ at a pressure of 200 or 300 torr, whereby in any case the pressure of the $CO_2$ is much below atmospheric pressure. This operating position is shown in FIGS. 2 and 4.

Then, by adding more pressure medium to the lifting cylinder 1, the piston rod 3 together with the plate-like member 4 is moved upwardly until the upper edge of the can 6 fits into the edge 29 of the lid 28 and this ensemble, together with the pressure plate 22, is pressed against the force of the compression springs 26 against the base plate 19 or the stop 43 on the pressure ring 31, the pressure ring 31 simultaneously turning over the outwardly projecting part 44 of the edge 29 of the lid 28 around the edge of the can 6.

This upward movement into the sealing position is possible because the sealing plate 7 is displaceable relative to the recess on the surface of the plate-like member 4 on the piston 3 or the cylindrical part 11 against the force of the compression spring 9, whereby only the sealing sleeve 10, if it is provided, stretches axially. This operating position is shown in FIG. 3.

After the can 6 is vacuum sealed, the piston rod 3 with the plate-like member 4 returns to its lower position, air having been admitted through the pressure-equalizing valve 45 into vacuum chamber 35. When the piston rod 3 descends, the can 6 is pushed or moves out of the sealing device 14 by virture of its own weight and if this is not sufficient, by the force of the compression springs 26.

It should be pointed out that the can 6 with the lid 28 is known, for example, from German Offenlegungsschrift (laid open patent application) No. 2,263,362.

In contrast to the embodiment shown and described above, for example, the vacuum bell 15 can be mounted firmly on the plate-like member 4, whereby the seats 16 and 17 must be brought into contact with corresponding seats on the upper edge of the vacuum bell 15 and on the sealing device 14. This modification has the disadvantage however that the cans 6 with the lids 28 must be inserted from above into the vacuum bell 15 and removed at the top.

Furthermore, it is also possible, without otherwise changing the design, to mount the plate-like member 4 in a fixed position and to make the sealing device 14 movable up and down by the lifting cylinder 1. This design would be especially advantageous if automatic feed and automatic transport of the cans away from the machine is to be provided, for which purpose it is advantageous to make the recess fixed, i.e., vertically non-displaceable.

It is to be appreciated that other embodiments and variants can be provided without departing from the spirit and scope of the invention, its scope being defined in the appended claims.

What is claimed is:

1. In an apparatus for sealing cans with lids under vacuum, the apparatus including a vacuum chamber, the chamber being formed by a vacuum bell and a sealing plate, said vacuum bell forming a portion of one of two parts movable with respect to one another by a lifting device to define in one position a closed condition of the vacuum chamber and in another position an open condition of the vacuum chamber, the bell addressing the sealing plate in a gas-tight manner to seal the vacuum chamber when the two parts are in one relative position with respect to one another; and support for receiving a can in the lower of the two parts; and a pressure plate movable to a limited extent relative to the upper one of the two parts and forming part of a sealing device provided to press a lid onto a can, the improvement wherein only one part of said two parts is movable relative to a fixed point, the other part of said two parts being fixed relative to a fixed point; wherein said vacuum bell and said sealing plate are movable relative to the movable part when said vacuum chamber is closed while being stationary relative to said fixed point; wherein said lifting device comprises a stoppable device which can be stopped in an intermediate position in which said vacuum chamber is closed and said pressure plate is still in a position a short distance from a can sought to be sealed; including a stop means; wherein said pressure plate is displaceable by the can into a position against said stop means whenever said lifting device is in a given one of its end positions; and wherein said sealing plate is mounted in a gas-tight manner on the lower one of said two parts, said support being displaceable in a flexible manner relative to the sealing plate when said vacuum bell rests against said sealing plate and said lifting device is moved toward said given one of its end positions.

2. An improved apparatus according to claim 1, including at least one sealing ring provided between said sealing plate and said vacuum bell.

3. An improved apparatus according to claim 1, including an axially stretchable sealing sleeve provided between the movable one of said two parts and said sealing plate.

4. An improved apparatus according to claim 1, wherein said vacuum bell is an integral portion of the upper one of said two parts.

5. An improved apparatus according to claim 1, wherein said stop means is a first stop, and further including a second stop and a base plate, and wherein said pressure plate is mounted in a guided fashion on said base plate and is displaceable between an upper position and a lower position delimited by said first and second stops.

6. An improved apparatus according to claim 1, wherein said pressure plate is provided with a holding means for lifting a lid off a can sought to be sealed when in the position a short distance from the can.

7. An improved apparatus according to claim 6, wherein said holding means is a permanent magnet.

8. An improved apparatus according to claim 1, wherein said lifting device is pneumatically drivable.

* * * * *